US005193767A

United States Patent [19]

Mihirogi

[11] Patent Number: 5,193,767

[45] Date of Patent: Mar. 16, 1993

[54] GIRDER TYPE SWITCH TRACK

[75] Inventor: Kiyoshi Mihirogi, Odawara, Japan

[73] Assignee: HSST Corporation, Tokyo, Japan

[21] Appl. No.: 748,591

[22] Filed: Aug. 22, 1991

[30] Foreign Application Priority Data

Aug. 31, 1990 [JP] Japan ..... 2-230812

[51] Int. Cl.[5] ..... E01B 7/06

[52] U.S. Cl. ..... 246/418; 246/445; 104/103

[58] Field of Search ..... 246/415 R, 415 A, 417, 246/418, 445, 452; 104/96, 100, 101, 102, 103, 130, 130.1

[56] References Cited

U.S. PATENT DOCUMENTS

| | | | |
|---|---|---|---|
| 55,494 | 6/1866 | Willard | 246/417 |
| 400,164 | 3/1889 | Bartholomew | 246/417 |
| 1,404,177 | 1/1922 | Lake | 104/103 |
| 1,487,244 | 3/1924 | Krump | 104/103 |
| 2,903,972 | 9/1959 | Schutze | 104/103 X |
| 2,997,004 | 8/1961 | Rosenbaum et al. | 104/103 X |
| 4,016,818 | 4/1977 | Ellzey | 104/130 X |
| 4,109,584 | 8/1978 | Mihirogi . | |
| 4,993,326 | 2/1991 | Bergemann | 104/103 X |
| 5,087,001 | 2/1992 | Bolli et al. | 246/415 A X |

FOREIGN PATENT DOCUMENTS

| | | | |
|---|---|---|---|
| 60-30801 | 10/1981 | Japan . | |
| 62-185919 | 8/1987 | Japan . | |
| 729282 | 5/1955 | United Kingdom | 246/418 |

*Primary Examiner*—Frank E. Werner
*Assistant Examiner*—Scott L. Lowe
*Attorney, Agent, or Firm*—Jordan and Hamburg

[57] ABSTRACT

A switch track apparatus for a girder type track comprises a movable girder composed of at least one girder portion shiftable between a plurality of positions on a fixed supporting member and of at least one drive device for driving the movable girder. The drive device is supported on a side surface of the movable girder substantially within a thickness of the movable girder.

7 Claims, 3 Drawing Sheets

GIRDER TYPE SWITCH TRACK

FIELD OF THE INVENTION

The present invention relates to a girder type switch track for use in a branching point of a girder type track for guiding vehicles such as a magnetic levitating type linear motor car or a monorail car.

BACKGROUND OF THE INVENTION

A girder type track for guiding a vehicle, such as a track for supporting and guiding a monorail car is well known.

Japanese Patent Application Hei-2-63752, discloses a switch track for use in a switch portion of such girder type track comprising a movable girder arranged on a fixed supporting member and driven by an external drive means such as hydraulic cylinder to switch one main track between a plurality of other main tracks.

In such a girder type switch track, means for moving the movable girder occupies a large space.

In order to solve this problem, a mechanism has been considered which employs a mechanical drive device mounted on a fixed supporting member and switches the movable girder with a mechanical drive device (Jpn. Patent Application Hei-2-225499).

On the other hand, a girder type track for a magnetic levitating type linear motor car is usually installed on or above a road. Therefore, such girder type track should be concordant with space in a city. Otherwise, installation of such track on a road might be objected to.

In the above-mentioned mechanism for such a girder type track, there is a tendency for the fixed supporting member to be thick since the drive device for driving the movable girder is mounted on the fixed supporting member. In this mechanism, the sum of heights of the fixed supporting member (or base girder), the drive device and the movable girder, that is, the distance from the lower surface of the fixed supporting member to an upper surface of the movable girder, is large. If the height of legs supporting the fixed supporting member is included, the distance will be very large and, therefore, underground portions of the legs must be deeply buried in order to sufficiently withstand the load related to the whole height of the switch track. Such structure can not be considered to be optimum for a magnetic levitating linear motor car.

SUMMARY OF THE INVENTION

An object of the present invention is to provide a switch track apparatus for a girder type track, whose girder height measured from an upper surface of a movable girder to a lower surface of a fixed supporting member is small.

Another object of the present invention is to limit field workload necessary to install the switch track to only the arrangement of the movable girder, the connection between the terminal portion of the drive device and guide members for guiding the movable girder and fine regulations thereof, by completing, assembling and testing operation of the switch track in factory.

A further object of the present invention is to compactly form a track girder including the movable girder and the fixed supporting member, to thereby match the external appearance of the whole installation to the space in a city and to remove any necessity of excessive reinforcement of the underground portions of the switch track.

A still further object of the present invention is to avoid the influence of thermal expansion/shrinkage of the drive device.

The above objects are achieved according to the present invention by a provision of the switch track apparatus for a girder type track comprising a movable girder comprised of at least one girder portion shiftable between a plurality of positions on a fixed supporting member and of at least one drive device for driving the movable girder. The drive device is installed on a side surface of the movable girder and it is supported by the movable girder substantially within the thickness of the movable girder. For example, all or a portion of the drive device is supported by the side surface of the movable girder and the rest thereof is received within an inside recess or the like of the movable girder. Therefore, the thickness of the movable girder with the drive device is substantially the same as that of a conventional girder without a drive device. The fixed supporting member or base girder for movably supporting the movable girder is not required to install and support the drive device directly. Therefore, there is no need for increasing the strength e.g., for its height and, thus, the supporting member can be as thin as possible so long as its strength is enough to support the movable girder. Therefore, the girder height which is at a distance from the upper surface of the movable girder to the lower surface of the base girder can be smaller than the thickness of the conventional switch track in which a movable girder is moved by an external hydraulic cylinder, etc., and, in addition thereto, there is no need to provide a large drive device for such hydraulic cylinder.

According to the present invention, maintenance of the switch track is facilitated, and a drive device including motors and various mechanical devices are generally minimized in size, and the formation of a fence for the girder track without obstructing the view is facilitated.

When a drive device is to be installed on the ground, a sprocket case or a ball screw case, etc., are housed as units within a larger case. According to the present invention, the drive device can be mounted on the movable girder portion with simple bearing means, utilizing structural strength of the girder. Thus, it can be manufactured economically.

BRIEF FIGURE DESCRIPTION

DISCLOSURE OF THE PREFERRED EMBODIMENT

The present invention is described in detail with reference to the drawings.

Figure 1:
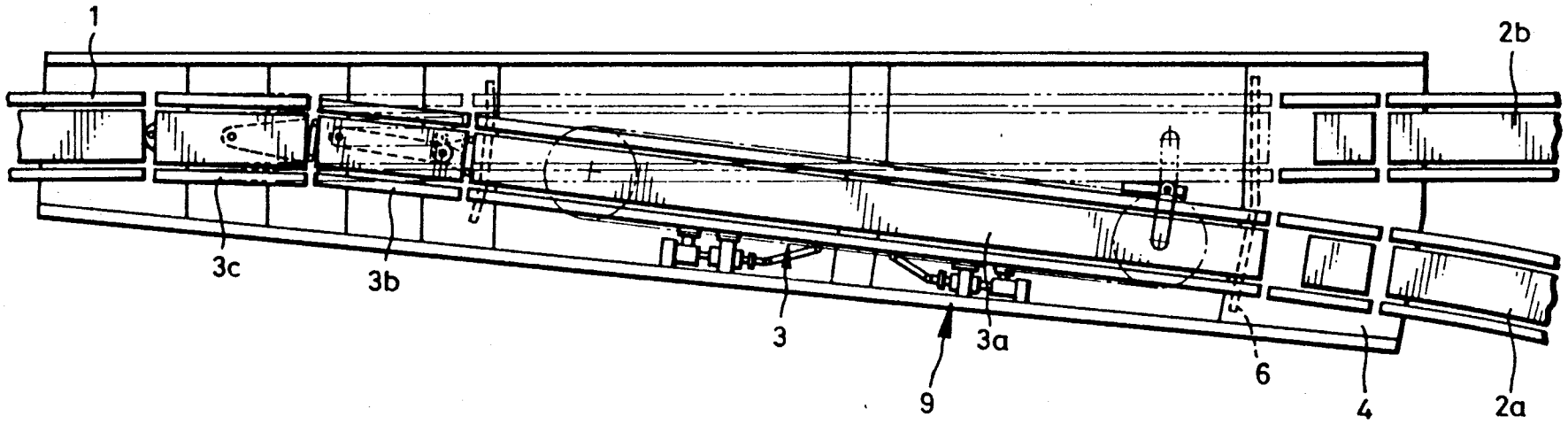
FIG. 1 is a plan view of a girder type switch track according to an embodiment of the present invention.

In FIG. 1, a movable girder 3 is provided between a main track 1 of a girder type track and a plurality of other main tracks thereof. In the illustrated case, a couple of other main tracks 2*a* and 2*b* are provided. By turning the movable girder 3, the main track 1 is selectively connected to either the first one 2*a* of the other tracks or the second other main track 2*b*.

Usually, the movable girder 3 includes a plurality of girder portions although there may be a case where only one girder portion is provided. These girder portions may have same or different length. In this embodiment, it includes a relatively long girder portion 3a and relatively short girder portions 3b and 3c. Such girder portions form a first path and a second path which are usually gently curved tracks although one of them may be straight. In FIG. 1, the movable girder portions 3a to 3c in the first path connecting the main track 1 to the first other main track 2a form a curved path and the movable girder portions 3a to 3c in the second path connecting the main track 1 to the second other main track 2b form a straight path. The respective movable girder portions may be provided with wheels to make their movement smooth.

The second girder portion 3b and third girder portion 3c are respectively turnable around fulcrums provided on a fixed supporting member 4 between the first path shown by solid lines and the second path shown by chain lines. The first girder portion 3a is turnable along a guide member provided on the fixed supporting member 4 between setting positions in the first path and the second path.

Figure 2:
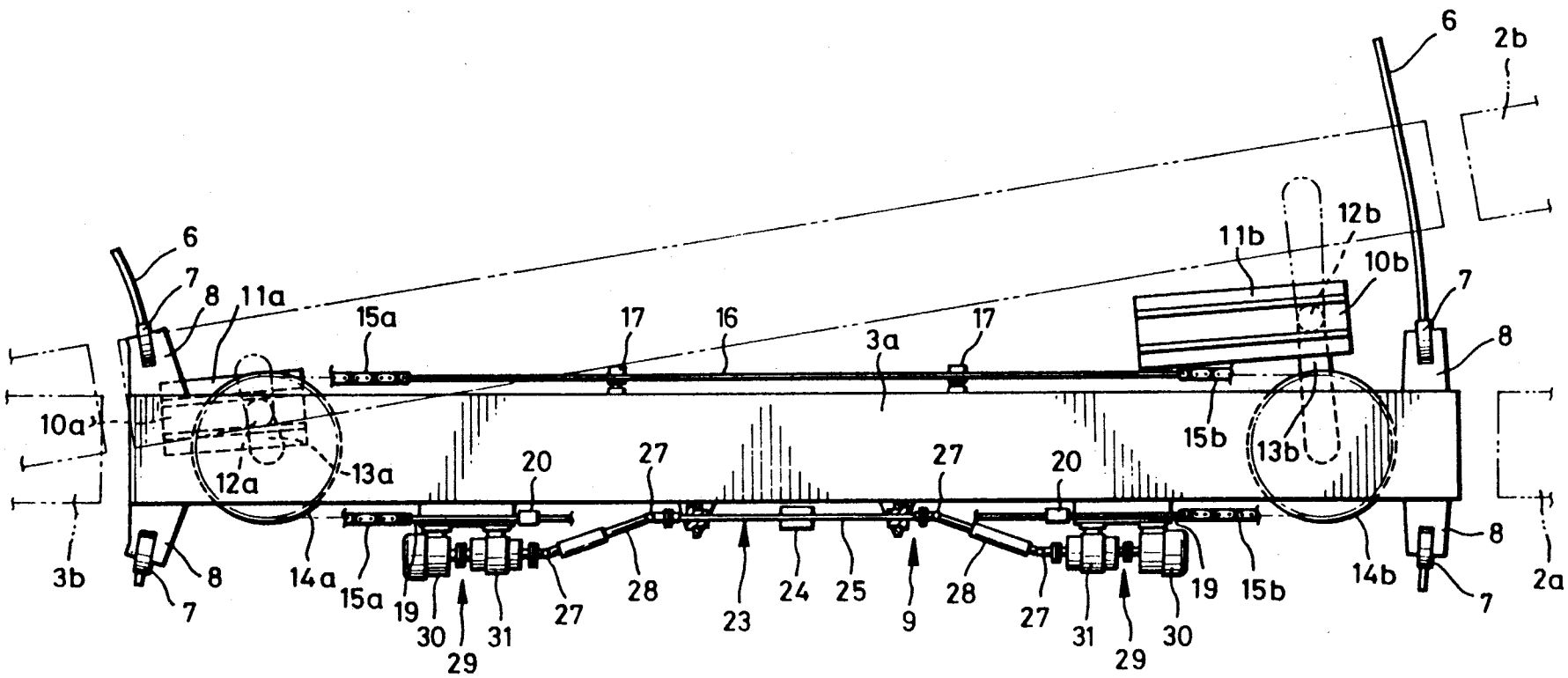
FIG. 2 is a plan view of a main portion of the track shown in FIG. 1.
Figure 3:
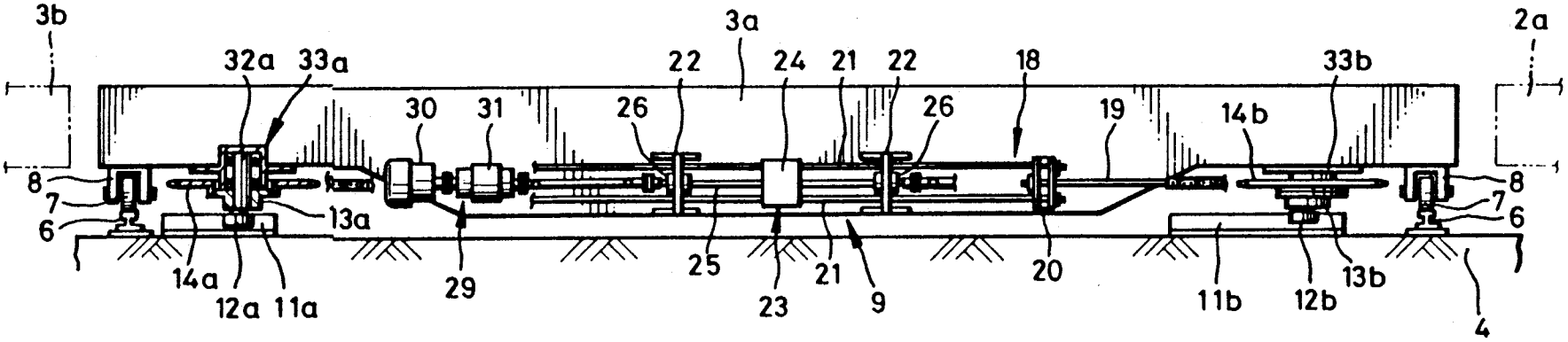
FIG. 3 is a side view of the portion in FIG. 2.
Figure 4:
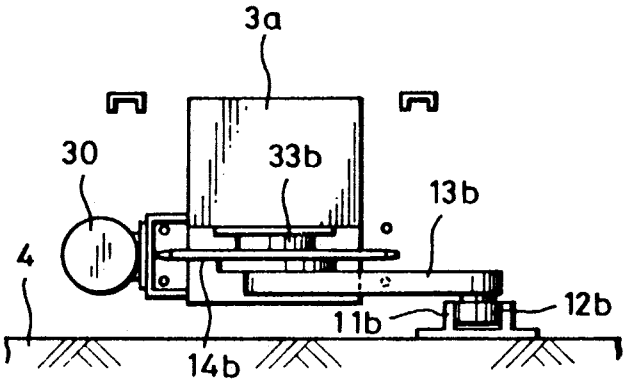
FIG. 4 is a front view of the portion in FIG. 2.

In FIGS. 2 to 4, with respect to the guide member for the first movable girder portion 3a, rails 6 are provided on the fixed supporting member 4 (or base girder) and wheels 7 guided by the rails 6 are supported through bearings 8 by the first movable girder portion 3a. The second and third movable girder portions 3b and 3c may be constituted similarly.

A drive device 9 is mounted on the first girder portion 3a and the latter is switched thereby between the first and the second paths.

For example, the drive device 9 may be constituted of guide members 11a and 11b having grooves 10a and 10b formed on the fixed supporting member 4 at both end portions of the first movable girder portion 3a in the longitudinal axis of the fixed supporting member 4, crank arms 13a and 13b having rollers 12a and 12b engaged with and guided by the guide members 11a and 11b, a first sprocket wheel 14a and a second sprocket wheel 14b respectively fixed to the crank arms 13a and 13b, and a first chain portion 15a and a second chain portion 15b engaged with the first and second sprocket wheels 14a and 14b. A shaft 32a supporting the crank arm 13a and the sprocket wheel 14a is in the form of a vertical shaft rotatably supported by a bearing 33a fixed to a bottom surface of the first movable girder portion 3a and a shaft 32b (not shown) supporting the crank arm 13b and the sprocket wheel 14b similarly is in the form of a vertical shaft rotatably supported by a bearing 33b fixed to a bottom surface of the first movable girder portion 3a.

One end of the first chain portion 15a is connected to one end of the second chain portion 15b facing to the end of the first chain portion 15a through a rod 16. The rod 16 is reciprocatively supported by guide rollers 17 mounted on one side surface of the first movable girder portion 3a. The other ends of the first and second chain portions 15a and 15b are connected to each other by a drive rod 18.

The drive rod 18 includes rod portions 19 connected to the chain portions 15a and 15b and a pair of parallel connecting rods 21 mutually connecting the rod portions 19 through a connecting member 20. The connecting rods 21 are reciprocatively supported by guides 22 mounted on the other side surface of the first movable girder portion 3a.

The connecting rods 21 are connected to a ball-screw device 23 and reciprocatively driven thereby. With the reciprocation of the connecting rods 21, the chain portions 15a and 15b are reciprocated.

The ball-screw device 23 includes a ball-nut 24 fixed to the connecting rods 21 and a screw shaft 25 screwed into the ball-nut 24. The screw shaft 25 is rotatably supported at both ends thereof by bearings 26 fixed in the guide 22 while being prevented from shifting axially. An end of the screw shaft 25 is connected to a drive portion 29 through a ball-joint 27 and a connecting rod 28. Although the screw shaft 25 can be driven by the drive portion 29 through one end thereof, its the other end is also connected to another drive portion 29 as a precaution against malfunction of the former. The drive portion 29 includes a motor 30 and a clutch-brake 31 connected to the motor 30. The drive portion 29 is fixed to a side surface of the first movable girder portion 3a. The screw shaft 25 is rotated by the drive portion 29 to move the ball-nut 24. Thus, the chain portions 15a and 15b are moved through the connecting rods 21 and the rod portions 19 to rotate the sprockets 14a and 14b to thereby rotate the crank arms 13a and 13b synchronously. Upon the rotation of the crank arms 13a and 13b at the terminal of the drive device, the fixed supporing member 4 provided correspondingly on the ground is subjected to force and, by reactive force thereto, the first movable girder portion 3a is moved along the rails 6 and rotated around an imaginary center. The mechanism of the drive device 9 is not limited to the illustrated one. Other mechanism such as hydraulic cylinder or link mechanism may be used therefor. Further, force may be applied to the first movable girder portion 3a not at both end points thereof, but at substantially a center point thereof.

The second and third movable girder portions 3b and 3c follow the movement of the first movable girder portion 3a. The second and third movable girder portions 3b and 3c may be respectively driven by drive devices similar to that used for the first movable girder portion 3a or by the first movable girder portion 3a as shown.

In the illustrated embodiment, the chain portions 15a and 15b, the rod 16, the rod portions 19, the connecting rods 21, the ball-screw device 23 and the drive portion 29 are arranged outside of the two sides of the first movable girder portion 3a. However, it is possible to arrange a portion of or whole portion of these members within the first movable girder portion 3a. Since these members can be substantially arranged within the thickness of the first movable girder portion 3a, the whole thickness of the arrangement of the drive device does not increase and there is no necessity of considering the reinforcement of the strength of the fixed supporting member 4 with respect to height of the drive device as well as the whole weight of the switch track apparatus.

What is claimed is:

1. A track switching apparatus for a girder type track comprising a movable girder having upper and lower surfaces and being comprised of at least one girder portion horizontally shiftable between a plurality of positions on a fixed supporting member and at least one drive device for driving said movable girder, said drive device being mounted on a side surface of said movable girder and being substantially completely in a space between the upper and lower surfaces of said movable girder.

2. The track switching apparatus claimed in claim 1, wherein at least a portion of said drive device is incorporated within said movable girder.

3. The track switching apparatus claimed in claim 1, wherein a rotational movement of at least an arm of a terminal of said drive device incorporated within said movable girder exerts force on said fixed supporting member and said movable girder is moved in a predetermined manner by reactive force thereto.

4. The track switching apparatus claimed in claim 1, wherein a linear movement of at least an arm of a terminal of said drive device incorporated within said movable girder exerts force on said fixed supporting member and said movable girder is moved in a predetermined manner by reactive force thereto.

5. A track switching apparatus for a girder type track comprising a movable girder having upper and lower surfaces and being comprised of at least one girder portion horizontally shiftable between a plurality of positions on a fixed supporting member and at least one drive device for driving said movable girder, said drive device being mounted on a side surface of said movable girder and being substantially completely in a space between the upper and lower surfaces of said movable girder, said movable girder including a plurality of said girder portions, only one of said girder portions being adapted to support said drive device on said side surface.

6. A track switching apparatus for a girder type track comprising a movable girder having upper and lower surfaces and being comprised of at least one girder portion horizontally shiftable between a plurality of positions of a fixed supporting member and at least one drive device for driving said movable girder, said drive device being mounted on a side surface of said movable girder and being substantially completely in a space between the upper and lower surfaces of said movable girder, said movable girder including a plurality of said girder portions and a plurality of said drive devices are provided, each said drive device being supported by one side surface of each said girder portions respectively.

7. A track switching apparatus for a girder type track comprising a movable girder having upper and lower surfaces and being comprised of at least one girder portion horizontally shiftable between a plurality of positions on a fixed supporting member and at least one drive device for driving said movable girder, said drive device being mounted on a side surface of said movable girder and being substantially completely in a space between the upper and lower surfaces of said movable girder, said drive device comprising:

a pair of guide members provided on said fixed supporting member in the vicinity of both ends of said movable girder portion and having a longitudinal groove extending along a longitudinal axis of said fixed supporting member;

a pair of arms having at both ends thereof rollers respectively engaged with and guided by said guide members;

a first and second sprocket wheels respectively fixed to said arms;

a first and second chain portions respectively engaged with said first and second sprocket wheels; and a drive portion driving said first and second sprocket wheels through said first and second chain portions, respectively.

* * * * *